US005673712A

United States Patent [19]

Nojiri

[11] Patent Number: 5,673,712

[45] Date of Patent: Oct. 7, 1997

[54] EYELASH CURLER

[75] Inventor: Hideyuki Nojiri, Tokyo, Japan

[73] Assignee: Preo Co., Ltd., Tokyo, Japan

[21] Appl. No.: 606,352

[22] Filed: Feb. 23, 1996

[30] Foreign Application Priority Data

Jun. 12, 1995 [JP] Japan ..... 7-169219

[51] Int. Cl.[6] ..... A45D 2/48

[52] U.S. Cl. ..... 132/217

[58] Field of Search ..... 132/216, 217

[56] References Cited

U.S. PATENT DOCUMENTS

| | | | |
|---|---|---|---|
| 2,159,912 | 5/1939 | Squire et al. . | |
| 2,598,719 | 6/1952 | Palmer | 132/217 |
| 2,712,317 | 7/1955 | Palmer | 132/217 |

FOREIGN PATENT DOCUMENTS

| | | | |
|---|---|---|---|
| 685 711 | 7/1930 | France . | |
| 753 738 | 10/1933 | France . | |
| 563982 | 9/1944 | United Kingdom | 132/217 |

*Primary Examiner*—Todd E. Manahan

*Attorney, Agent, or Firm*—Oblon, Spivak, McClelland, Maier & Neustadt, P.C.

[57] ABSTRACT

An eyelash curler which can provides stabilized performances in operating an eyelash holder member 6 and an eyelash pressing member 7 toward and away from each other in an appropriately faced state and free of deviational movements, without using for the eyelash holder member a guide member which is provided in a projected state obstructive of eyelash curling operations. The eyelash curler essentially includes a pair of scissor arms 1 and 2 pivoted on a pivoting pin 3 for opening and closing movements relative to each other, an eyelash pressing member 5 mounted at the distal end of one scissor arm 1, a link lever 7 having an eyelash holder member 6 on a fore end portion thereof and pivotally supported at its base end on a middle portion of the scissor arm 1, an intermediate link 11 connected between fore end portions of the link lever 7 and the other scissor arm 2, and a guide portion 12 provided on the scissor arm 1 at the connection and in association with the link lever 7 to suppress saccadic movements of the lever 7.

5 Claims, 3 Drawing Sheets

EYELASH CURLER

BACKGROUND OF THE INVENTION

1. Field of the Art

This invention relates to an eyelash curler, and more particularly to a scissor type eyelash curler which is arranged to guarantee stabilized performances in eyelash curling operations, and which is capable of beautifully curling eyelashes free of distortions.

2. Prior Art

Generally, in order to shape eyelashes into a beautifully curled form, it is necessary for an eyelash curler to be able to provide stable performances in curling operations by an eyelash pressing member and an eyelash holder member which can be operated toward and away from each other in a properly faced state free of deviational movements in the direction of an eyelash gripping line between the eyelash pressing and holder members (in the direction of an eyelash gripping line extending longitudinally of the eyelash pressing and holder members). Deviational movements of the above-mentioned eyelash pressing and holder members in the direction of the eyelash gripping line could cause the eyelashes between them to roll over in deviational directions, making it difficult to set the eyelashes in a desired curled shape.

As a countermeasure for this problem, in the case of scissor type eyelash curlers which have been in wide use and which have a pair of scissor arms pivoted on a pivoting pin in the fashion of a pair of scissors, various attempts have been made to prevent deviational movements of eyelash pressing and holder members as caused by saccadic movements at the pivotally connected portions of the scissor arms, by providing guide members on the scissor arm on the part of the eyelash pressing member in such a manner as to guide the opposite ends of the eyelash holder for upward and downward movements during a curling operation, maintaining the eyelash holder member in a properly faced position relative to the eyelash pressing member free of positional deviations. However, it has been found that guide members of this sort have inherent drawbacks because they tend to obstruct the eyelash curling operations, barring to use the entire length of a gripping portion between the eyelash pressing and holder members effectively from one end to the other, resulting in inferior operational performance quality.

SUMMARY OF THE INVENTION

It is an object of the present invention to provide a scissor type eyelash curler as mentioned above, which can guarantee stabilized operational performances by an eyelash pressing member and an eyelash holder member which are movable toward and away from each other in a properly faced state, free of positional deviations in the direction of an eyelash gripping line to obviate the use of the conventional guide means for the eyelash holder member, thereby precluding the above-mentioned problem of the conventional guide means which easily come into the way of eyelash curling operations, and at the same time enabling the user to curl eyelashes into a distortion-free beautifully curled shape.

It is another object of the present invention to provide an eyelash curler which employs an extremely simple means for operating the eyelash holder member and pressing members toward and away from each other stably in a properly faced state and without deviations in the direction of an eyelash gripping line between the holder and pressing members.

As for means for operating the eyelash holder and pressing members in properly faced relations with each other as mentioned above, generally it is conceivable to step up the level of precision machining operations on mechanical parts taking part in the pivoting movements of the paired scissor arms, which are pivotally supported on a pivoting pin, to such a degree as to preclude the possibilities of saccadic movements of the respective scissor arms at their pivotally connected portions. However, such a solution means invariably leads not only to increases in manufacturing and machining costs of the scissor arms, but also to scissor arms which lack smoothness in opening and closing movements due to tight frictional contact of precision machined surfaces.

It is a further object of the present invention to provide a simple and inexpensive eyelash curler construction which makes it possible to operate the eyelash holder and pressing members toward and away from each other in a properly faced state and free of deviational movements in the direction of the eyelash gripping line, without necessitating to step up the level of precision machining operations on the component parts which are associated with pivoting movements of the paired scissor arms.

It is still a further object of the invention to provide an eyelash curler which is arranged to clamp eyelashes between an eyelash holder member and an eyelash pressing member through a resilient member of a synthetic resin material, which is provided on the eyelash holder member and adapted to be partially deviated in the direction of an eyelash gripping line under the influence of a clamping force applied by the pressing member, in such a way as to prevent twisting of eyelashes thereby permitting to curl same in an appropriate direction.

It is another object of the present invention to provide an eyelash curler which is arranged to guarantee safety of the eyeball and surrounding facial areas of the user even in the event of unexpected breakage of a component part or parts on which a relatively large force is applied at the time of a curling operation.

In accordance with the present invention, the above-stated objectives are achieved by the provision of a scissor type eyelash curler including a pair of scissor arms pivotally supported on a pivoting pin for opening and closing movements in the fashion of a pair of scissors, and an eyelash gripper including an eyelash holder member and an eyelash pressing member to be operated toward and away from each other and in face to face relation with each other by closing and opening movements of the scissor arms, characterized in that the eyelash curler essentially includes: an eyelash pressing member mounted on a fore end portion of one of the scissor arms; a link lever having a base end portion thereof pivotally supported on the one scissor arm through a support pin at a point intermediate between the eyelash pressing member and the pivoting pin of the paired scissor arms, and supporting an eyelash holder member securely on a fore end portion thereof in a face to face relation with the eyelash pressing member; an intermediate link member pivotally connected between a fore end portion of the link lever and a fore end portion of the other scissor arm; and a guide tongue provided on the one scissor arm at the connection and in association with the link lever to restrict saccadic movements of the link lever in a direction perpendicular to a rotational plane about the axis of the support pin.

In the above-defined eyelash curler, the link lever is constituted by a pair of lever plates which are pivotally supported in their base end portions on the one scissor arm through the above-mentioned support pin in such a manner as to embrace the one scissor arm from the opposite sides thereof, and the guide tongue is held in intimate contact with inner surfaces of the lever plates to restrict saccadic movements of the link lever.

Further, the eyelash holder member is preferably constituted by a nesting piece of a channel-like shape in section securely mounted on a fore end portion of the link lever, and a resilient member of synthetic resin material fitted in the nesting piece, the resilient member of synthetic resin material being formed in a hollow cylindrical shape internally defining an axial hole substantially at a center position for absorption of deformations of the resilient member at the time of an eyelash clamping operation.

In the eyelash curler of the construction Just described, it is preferable, from the standpoint of securing safety of operation, to connect the intermediate link to a fore end portion of the link lever at a position on the inner side of a protective cover wall which is provided fixedly at the fore distal end of the link lever.

With an eyelash curler of the above-described arrangements, after placing eyelashes between the eyelash pressing and holder members of the eyelash gripper portion, the eyelash pressing member is closed and pressed against the eyelash holder member through manipulation of the paired scissor arms. At this time, as the link lever is turned about the support pin through the intermediate link, the guide tongue which is formed integrally on the above-mentioned one scissor arm functions to guide base end portions of the link lever, preventing its saccadic movements at its pivoting connection with the scissor arm to maintain stabilized operational performances of the eyelash curler, particularly free of saccadic movements in a direction perpendicular to a rotational plane about the support pin of the link lever. Besides, the suppression of saccadic movements of the link lever can be achieved by the of the guide tongue of an extremely simple form, so that the eyelash curler of the invention does not involve any high precision machining operations for other component parts in its manufacturing process, more specifically, neither for the pivotal support portions of the paired scissor arms nor for the connecting portions of the intermediate link. In other words, the eyelash curler of the invention can be fabricated at a significantly low cost as a whole.

Further, the resilient member of synthetic resin material which is fitted in the channel-like nesting piece of the eyelash holder member partially undergoes deformations under the pressure which is exerted thereon by the eyelash pressing member. In this regard, one may consider that the surface of the resilient member will be pushed into deviated positions toward its opposite lateral sides along an eyelash gripping line. However, the axial hole which is provided internally and centrally of the resilient member functions to absorb its deformations, suppressing surface-wise deviational movements of the resilient member which would otherwise cause twisting of eyelashes, and accordingly permitting to impart the eyelashes with a beautifully curled shape in a proper direction.

Further, it should be taken into consideration that, at the time of clamping eyelashes to shape, an extremely large force is usually applied on the eyelash gripping portion by the leverage action of the scissor arms. Therefore, the connection between the link lever and the intermediate link could be broken apart unexpectedly due to an unforeseeable reason, freeing the fore end of the intermediate link to project in a forward direction toward the eyeball of the user. In order to cope with this problem, the intermediate link is connected to the link lever at a position inside a protective cover wall which is provided at the fore end of the link lever in such a manner as to catch the fore end of the intermediate link therein in the event of breakage of the connection between the intermediate link and the link lever, guaranteeing safety of the eyeball and surrounding facial areas of the user during use of the eyelash curler.

DESCRIPTION OF PREFERRED EMBODIMENTS

Figure 1:
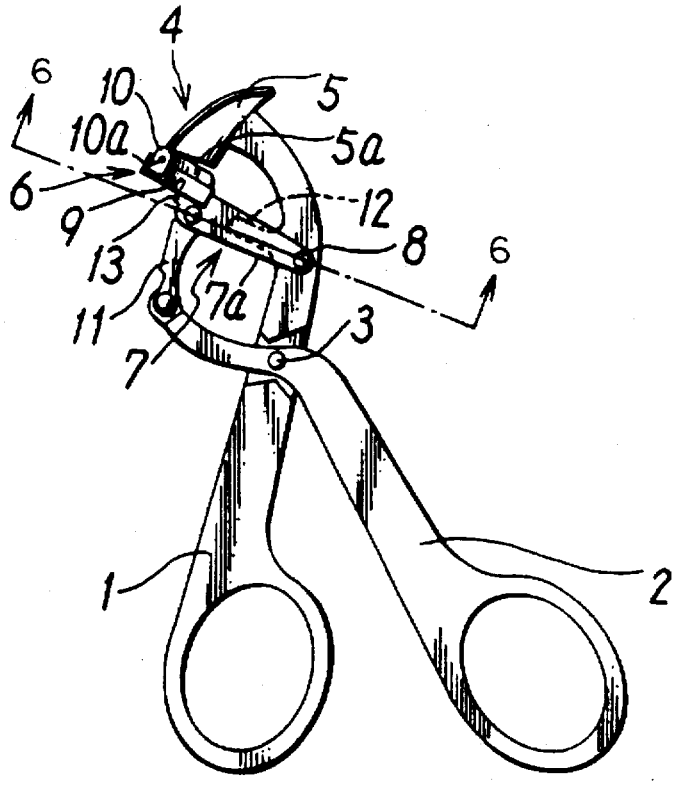
FIG. 1 is a schematic side view of an eyelash curler according to the invention.
Figure 2:
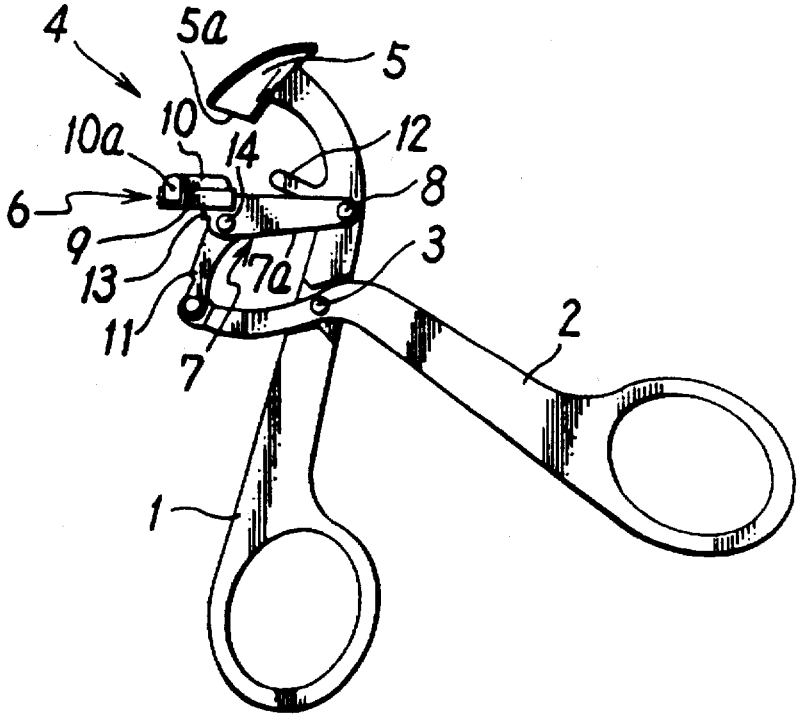
FIG. 2 is a view similar to FIG. 1, showing scissor arms in an opened state.
Figure 3:
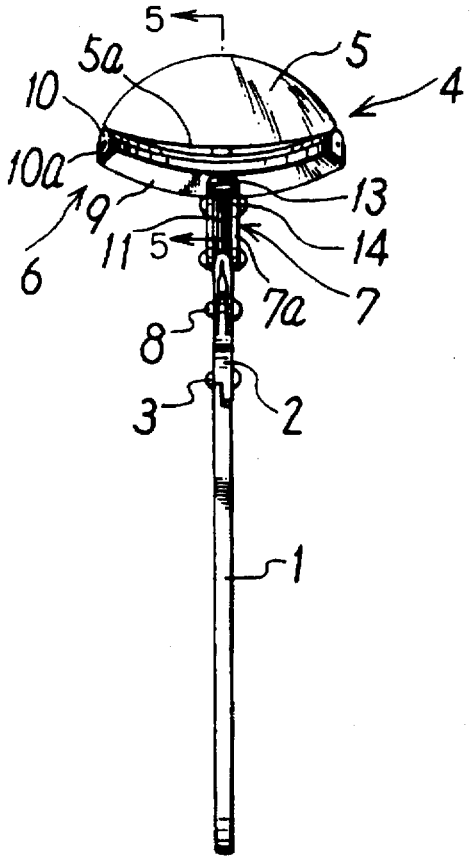
FIG. 3 is a schematic front view of the eyelash curler of FIG. 1.
Figure 4:
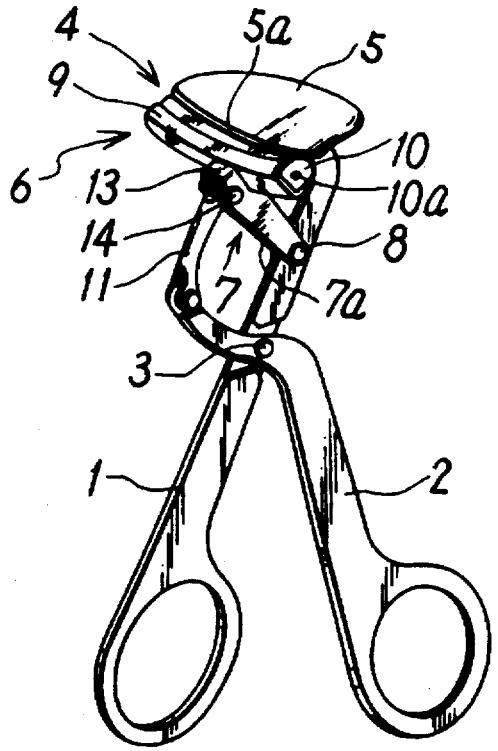
FIG. 4 is a perspective view of the same eyelash curler.

Referring to FIGS. 1 through 6, there is shown an embodiment of the eyelash curler according to the present invention. As seen in FIGS. 1 through 4, the eyelash curler of the invention is of the scissor type basically including a pair of scissor arms 1 and 2 which are connected with each other through and pivoted on a pivoting pin 3 for opening and closing movements in the fashion of a pair of scissors. By opening and closing the paired scissor arms 1 and 2, an eyelash pressing member 5 and an eyelash holder member 5 of an eyelash gripper 4, which are disposed in a face to face relation, are opened and closed by movements toward and away from each other.

The above-mentioned eyelash pressing member 5, which serves to clamp eyelashes to a curled shape, is securely mounted on a fore end portion of one scissor arm 1, and provided with an eyelash pressing edge 5*a* of a substantially arcuate shape along edges of its end face which confronts the eyelash holder member 6.

On the other hand, the eyelash holder member 6, which serves to hold eyelashes from beneath, is securely mounted on a fore end portion of a link lever 7 which is pivotally supported at its base end on the scissor arm 1 through a support pin 8 at an intermediate point between the above-mentioned eyelash pressing member 5 and the pivoting pin 3 of the scissor arms 1 and 2. This eyelash holder member 6 is constituted by a nesting piece 9 of a channel-like shape securely mounted on a fore end portion of the link lever 7, and a resilient member of a synthetic resin material securely fitted in the nesting piece 9 substantially in an arcuate shape similarly to the above-described pressing edge 5*a*. The resilient member 10 of synthetic resin material is generally formed in a tubular shape and internally provided with an axial hole 10*a* substantially at a center position thereof, thereby to absorb deformations of the resilient member during eyelash clamping operations.

The link lever 7 has its fore end portion connected to a fore end portion of the other scissor arm 2 through an intermediate link 11. In cooperation with the scissor arms 1 and 2, the link lever 7 and intermediate link 11 form the so-called parallel link mechanism.

Figure 5:
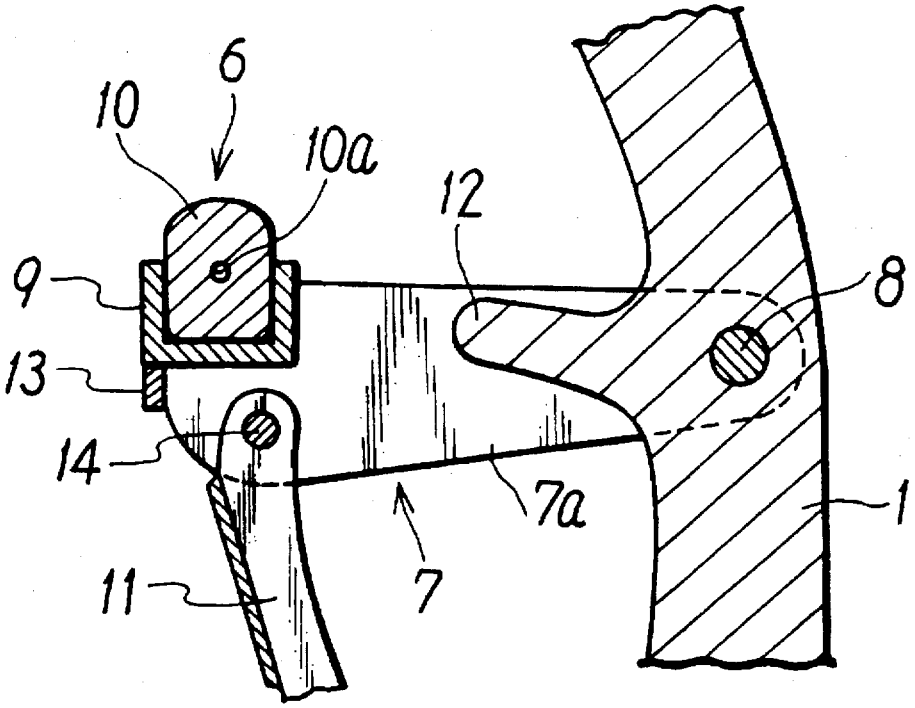
FIG. 5 is a sectional view on an enlarged scale, taken on line A—A of FIG. 3.
Figure 6:
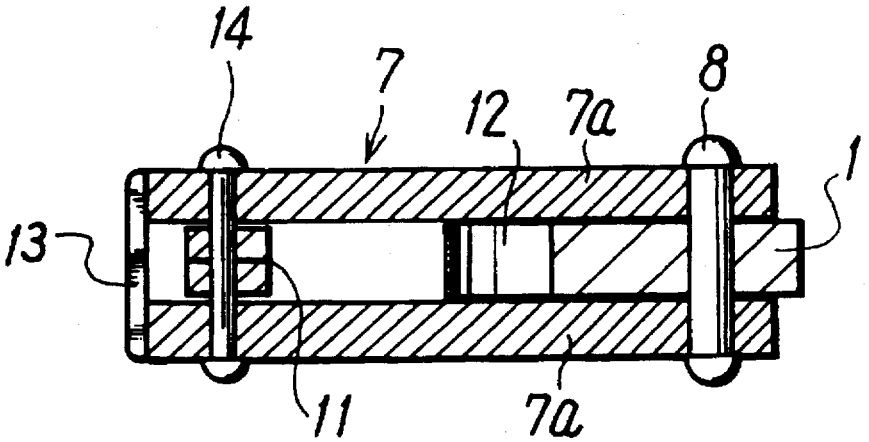
FIG. 6 is a sectional view on an enlarged scale, taken on line B—B of FIG. 1.

Projected integrally from the scissor arm 1 at its connection with the link lever 7 is a guide tongue 12 which functions to suppress saccadic movements of the link lever 7 in a direction perpendicular to a rotational plane about the axis of the support pin 8 of the link lever 7. More specifically, the link lever 7 is constituted by a pair of lever plates 7*a* which embrace the scissor arm 1 from the opposite sides thereof, the lever plates 7*a* being pivotally supported at the respective base ends on the scissor arm 1 through the support pin 8. As seen in FIGS. 5 and 6, the guide tongue 12 which is provided on the scissor arm 1 is held in intimate contact with the inner sides of the respective lever plates 7*a* thereby to prevent saccadic movements of the link lever 7 as mentioned hereinbefore.

The paired lever plates 7*a* of the link lever 7 are connected with each other at the respective fore ends by means of a protective cover wall 13 which is securely fixed to the lower side of the channel-like nesting piece 9. The intermediate link 11 is pivotally connected to the fore end of the link lever 7 by a pin 11 which is located inside the just mentioned protective cover wall 13.

In use of the eyelash curler of the above-described arrangements, eyelashes are firstly gripped between the eyelash pressing and holder members 5 and 6 of the gripper portion 4 which functions to curl up eyelashes, and then the scissor arms land 2 are closed toward each other to clamp the eyelashes more firmly between the eyelash pressing and holder members 5 and 6, for imparting a desired curled shape to the eyelashes. At the time of this curling operation, the link lever 7 is turned about the axis of the support pin 8 through the intermediate link 11, and, during this movement, the link lever 7 is guided by the guide tongue 12 on the scissor arm 1, which is in engagement with the base end portions of the link lever 7 to prevent its saccadic movements in a direction perpendicular to a rotational plane about the axis of the support pin 8, maintaining stable operational performances of the eyelash gripper portion 4, free of troubles as experienced in the case of conventional eyelash curlers with guide means which easily come into contact with the face of the user in such a way as to obstruct a curling operation.

Further, during the curling operation, the resilient member 10 of synthetic resin material which is securely fitted in the channel-shaped nesting piece 9 of the eyelash holder member 6 partially undergoes deformation under the pressure which is exerted thereon by the eyelash pressing member 5. In this regard, contrary to an ordinary assumption that the surfaces of the resilient member 10 would be pushed into a deviated position in the direction of the eyelash gripping line, its deformative movements are absorbed by the internal axial hole 10*a*, preventing twisting movements of eyelashes which would otherwise take place due to deviational movements at the surface of the resilient member 10. As a consequence, eyelashes can be curled beautifully in an appropriate direction.

Furthermore, due to the extremely large leverage force which is exerted on the gripper portion 4 by the paired scissor arms 1 and 3 at the time of an eyelash clamping operation, there are possibilities of the connection between the intermediate link 11 and the link lever 11 being broken unexpectedly during use, letting the freed fore end of the intermediate link 11 protrude in the direction of the eyeball of the user. However, the eyelash curler construction of the invention is immune from such an accident since the fore end of the intermediate link 11 is connected to the link lever 7 at a position on the inner side of the protective cover wall 13 at the distal end of the link lever 7 as described hereinbefore. Namely, even in the event of breakage of the connection between the intermediate link 11 and the link lever 7, the fore end of the intermediate link 11, which would otherwise tend to protrude toward the users face, is suitably intercepted by the protective cover wall 13 to guarantee safety of the eyeball and surrounding facial areas of the user during curling operations.

As clear from the foregoing description, the eyelash curler according to the invention can operate the eyelash holder and pressing members toward and away from each other in a properly faced state free of positional deviations in the direction of an eyelash gripping line, ensuring stabilized performances in operation by the use of an extremely simple guide means.

What is claimed is:

1. A scissor type eyelash curler including a pair of scissor arms pivotally supported on a pivoting pin for opening and closing movements in the fashion of a pair of scissors, and an eyelash gripper including an eyelash holder member and an eyelash pressing member provided in a face to face relation with each other and operated toward and away from each other by closing and opening movements of said scissor arms, characterized in that said eyelash curler essentially comprises:

said eyelash pressing member mounted on a fore end portion of one scissor arm for pressing eyelashes;

a link lever having a base end portion thereof pivotally supported on said one scissor arm through a support pin at a point intermediate between said eyelash pressing member and said pivoting pin of said paired scissor arms, and fixedly supporting said eyelash holder member on a fore end portion thereof in a face to face relation with said eyelash pressing member;

an intermediate link member pivotally connected between a fore end portion of said link lever and a fore end portion of the other scissor arm; and a guide tongue integrally provided on said one scissor arm at the connection with and in association with said link lever to restrict saccadic movements of said link lever in a direction perpendicular to a rotational plane about the axis of said support pin.

2. An eyelash curler as defined in claim 1, wherein said link lever is constituted by a pair of lever plates, which lever plates being pivotally supported on said one scissor arm through said support pin at the respective base end portions located to embrace opposite sides of said one scissor arm, and said guide tongue is held in intimate contact with inner surfaces of said lever plates to restrict saccadic movements of said link lever.

3. An eyelash curler as defined in claim 1, wherein said eyelash holder member is constituted by a nesting piece of a channel-like shape securely mounted on a fore end portion of said link lever, and a resilient member of synthetic resin material securely fitted in said nesting piece.

4. An eyelash curler as defined in claim 3, wherein said resilient member is formed in a hollow tubular shape internally provided with an axial hole substantially at a center position thereof for absorption of deformations of said resilient member at the time of an eyelash clamping operation.

5. An eyelash curler as defined in one of claims 1 to 3, wherein said intermediate link is connected to a fore end portion of said link lever at a position on the inner side of a protective wall securely fixed to the fore distal end of said link lever.

* * * * *